US007603831B2

(12) United States Patent
Sperry et al.

(10) Patent No.: US 7,603,831 B2
(45) Date of Patent: Oct. 20, 2009

(54) PACKAGING MACHINE AND METHOD

(75) Inventors: Laurence B. Sperry, Boston, MA (US); Eric A. Kane, Lynn, MA (US); Atul Arora, Piscataway, NJ (US); Charles Kannankeril, North Caldwell, NJ (US); Ross Patterson, Boston, MA (US)

(73) Assignee: Sealed Air Corporation (US), Elmwood Park, NJ (US)

( * ) Notice: Subject to any disclaimer, the term of this patent is extended or adjusted under 35 U.S.C. 154(b) by 576 days.

(21) Appl. No.: 11/093,731

(22) Filed: Mar. 30, 2005

(65) Prior Publication Data

US 2006/0218883 A1 Oct. 5, 2006

(51) Int. Cl.
*B65B 57/12* (2006.01)
*B65B 9/02* (2006.01)

(52) U.S. Cl. ..... 53/450; 53/553; 53/57; 53/58; 53/73; 53/74

(58) Field of Classification Search ..... 53/325, 53/371.4, 389.4, 450, 550, 500, 505, 64, 53/57, 58, 493, 498, 553, 73, 74
See application file for complete search history.

(56) References Cited

U.S. PATENT DOCUMENTS

| | | | | | |
|---|---|---|---|---|---|
| 2,597,042 | A | * | 5/1952 | Stokes et al. | 53/509 |
| 2,627,150 | A | * | 2/1953 | Cheney et al. | 53/553 |
| 3,055,246 | A | * | 9/1962 | Steinberg | 53/58 |
| 3,397,505 | A | * | 8/1968 | Critchell | 53/74 |
| 3,614,853 | A | * | 10/1971 | Seragnoli | 53/74 |
| 4,217,744 | A | * | 8/1980 | Mizutani | 53/74 |
| 4,313,288 | A | * | 2/1982 | Tassi et al. | 53/74 |
| 4,532,751 | A | * | 8/1985 | Mally et al. | 53/396 |
| 4,617,470 | A | | 10/1986 | Horikawa | |
| 4,878,336 | A | | 11/1989 | Kohler | |
| 5,062,340 | A | | 11/1991 | Greven | |
| 5,351,464 | A | * | 10/1994 | Francioni | 53/450 |

(Continued)

FOREIGN PATENT DOCUMENTS

EP 0 272 337 * 12/1986

(Continued)

OTHER PUBLICATIONS

Search Report for corresponding European Application No. 06251710.7 mailed Jun. 28, 2006.

*Primary Examiner*—Stephen F Gerrity
(74) *Attorney, Agent, or Firm*—Alston & Bird LLP

(57) ABSTRACT

A packaging method and apparatus wherein each product is packaged by capturing the product in flexible packaging material. The packing apparatus includes a product detector for detecting the presence or absence of a product to be packaged. The detection of the product may cause the advancement of packaging material and the product through a nipping station to form a package. The failure to detect a product may cause the advancement of the packaging material to stop and conserve packaging material until a product is detected. The product detector may be a color sensor trained to detect a color of the first web, a luminescence sensor trained to detect a luminance of the first web, or a light-sensitive sensor trained to detect a difference in light passing through the first web. Also, a luminescence additive may be joined with the lower web to provide a distinct luminance.

17 Claims, 3 Drawing Sheets

U.S. PATENT DOCUMENTS

| | | | | |
|---|---|---|---|---|
| 5,371,999 | A * | 12/1994 | Hansen et al. | 53/450 |
| 5,598,266 | A | 1/1997 | Cornuejols | |
| 5,614,063 | A | 3/1997 | Graf et al. | |
| 5,740,661 | A | 4/1998 | Yamaguchi et al. | |
| 5,966,908 | A | 10/1999 | Philipp et al. | |
| 6,002,125 | A | 12/1999 | Schubert | |
| 6,349,526 | B1 | 2/2002 | Newman | |
| 6,381,919 | B2 * | 5/2002 | Todd et al. | 53/64 |
| 6,877,294 | B2 * | 4/2005 | Hellmann et al. | 53/446 |
| 6,895,732 | B2 | 5/2005 | Sperry et al. | |
| 2002/0018208 | A1 | 2/2002 | Kemmler et al. | |
| 2003/0037515 | A1 * | 2/2003 | Herzog | 53/473 |

FOREIGN PATENT DOCUMENTS

| | | |
|---|---|---|
| EP | 0 304 978 | 3/1989 |
| EP | 0 311 213 | 4/1989 |
| EP | 1 396 428 | 3/2004 |

* cited by examiner

PACKAGING MACHINE AND METHOD

FIELD OF INVENTION

The present invention relates to machines and methods for packaging objects using flexible or semi-flexible sheet materials, wherein an object is disposed between two portions of sheet material and the two portions are sealed together about the periphery of the object to form a package.

BACKGROUND OF THE INVENTION

Flexible packaging has long been used to package products such as books, compact discs, cassette tapes, and a host of other types of objects to provide protection when shipping or mailing the objects, and in some cases to hermetically seal the objects from the outside environment. Web-handling machines have been developed to automate the process of packaging products in flexible packaging materials. Dual-web machines bring a pair of webs into generally parallel confronting relation with each other and feed a product, or a group of products, between the webs. At a downstream sealing station, the webs are sealed together around the product (s), thus forming a package containing the product(s). The package is severed from the remainder of the webs to complete the process. Single-web machines work similarly, except a single web is either supplied to the machine as a C-fold, or a flat web is manipulated and folded into a C-fold configuration, the objects to be packaged are inserted between the two opposing portions of the C-folded web, and one longitudinal seal and two cross seals are formed.

The web-handling machines typically are configured to operate continuously or manually. In a continuous mode, the machine's various motors and components are constantly running and driving the webs of material from their supply rolls through the nipping station and packaging any product placed between the webs. A continuous mode is often used when there is a continuous stream of products being placed between the webs to be packaged. Usually the continuous stream of products is delivered via an automatic conveying system, such as a conveyor belt.

A drawback of a continuous mode is the inevitable break in the continuous stream of products. For a variety of reasons, there will be unintended breaks in the stream of products being fed to the web-handling machine. When this happens while a machine is in continuous mode, the machine still advances the webs of material, but because of the missing product, portions of the webs of material are wasted. Also wasted are the energy and additional wear on the machine for running unnecessarily when no products are available for packaging.

In a manual mode, the various machine motors and components run only when an operator engages a selector switch, such as a cycle button. By hitting the cycle button, the machine is caused to operate through one cycle, wherein one product or set of products and portions of both webs are advanced through the sealing station to form a package. A manual mode is typically used when single products or relatively small batches of products are packaged and an operator physically places the products between the webs to be packaged.

Although a manual mode reduces possible wasted packaging material associated with a continuous mode, the manual mode also has its drawbacks. A primary drawback with a manual mode is the increase in the wear and tear in the machine's motors and components due to the multiple starts and short operating times that they must endure. Also, a manual mode does not eliminate wasted packaging material entirely. An operator may accidentally hit the cycle button and cause the machine to cycle without packaging a product, referred to herein as an empty cycle. Manual mode becomes more problematic if the products arrive in batches. In that case, an operator has to be present throughout the packaging of the entire batch in order to hit the cycle button between products. Even if the operator is able to select multiple cycles, this is not an entirely satisfactory solution because it increases the chances of running a cycle unnecessarily.

In light of the above considerations, a more versatile packaging machine and method are needed to prevent the machine from running unnecessarily and wasting packaging material and other resources.

BRIEF SUMMARY OF THE INVENTION

The present invention addresses the above needs and achieves other advantages, by providing a packaging apparatus and method that automates the process of packaging products and prevents empty cycles in the apparatus. The packaging apparatus includes a product detector for detecting the presence and/or absence of a product to be packaged. Upon detection of a product, the packaging material and the product to be packaged are advanced through a sealing station to form a package around the product. Upon failure to detect a product, the advancement of the packaging material is halted so as to conserve the packaging material until a product is detected.

According to one embodiment, the present invention provides a packaging apparatus for packaging products using continuous first and second webs of flexible packaging material. The packaging apparatus includes a packaging station, a web drive system, a product-sensing detector, and a controller. The packaging station has a pair of rollers that form a nip. The first and second webs with a product disposed therebetween are advanced through the nip in a longitudinal direction such that the webs are adhered to each other and envelop the product. The web drive system advances the first and second webs to the packaging station. In particular, the first web is advanced along a generally horizontal path from a product placement location at which a product to be packaged is placed onto the first web, toward the packaging station. The product-sensing detector is positioned adjacent the first web at or downstream of the product placement location and upstream of the packaging station. The position of the detector provides the product-sensing detector with a direct line of sight to the first web when no product is present on the first web. However, the line of sight is blocked by a product when the product is present on the first web. The product-sensing detector operates to detect a characteristic of the first web distinct from the products being packaged and to provide a signal of a first type when said characteristic is detected and of a second type when said characteristic is not detected which indicates a product is blocking the detector's line of sight. The controller is connected with the web drive system and will cause the web drive system to advance the first and second webs toward the packaging station when the signal from the product-sensing detector is of the second type.

The product-sensing detector can include various types of devices. For example, according to one embodiment the product-sensing detector is a color sensor which can detect the color of the first web. In another embodiment, the product-sensing detector is a luminescence sensor which can detect the luminance of the first web. This embodiment may also include a luminescence additive that is affixed to the first web to provide the luminance of the first web. In yet another embodiment, the present invention may further comprise a light source that passes light partially through the first web. With the light source, the product-sensing detector may be a light-sensitive sensor that can detect the light passing through the first web.

In another embodiment, the present invention provides a packaging apparatus for packaging products using continuous first and second webs of flexible packaging material. The packaging apparatus includes a packaging station, a web drive system, an infeed conveyor belt, a product-sensing detector, and a controller. The packaging station has a pair of rollers that form a nip. The first and second webs with a product disposed therebetween are advanced through the nip in a longitudinal direction such that the webs are adhered to each other and envelop the product. The web drive system advances the first and second webs to the packaging station. The infeed conveyor belt conveys the product to the packaging station from a product placement location at which a product to be packaged is placed. The product-sensing detector is positioned adjacent to the infeed conveyor belt at or downstream of the product placement location and upstream of the packaging station. The position of the product-sensing detector provides the detector with a direct line of sight to the infeed conveyor belt when no product is present on the infeed conveyor belt. However the line of sight is blocked by the product when the product is present on the infeed conveyor belt. The product-sensing detector can detect a characteristic of the infeed conveyor belt distinct from the products being packaged and to provide a signal of a first type when said characteristic is detected and of a second type when said characteristic is not detected, which indicates a product is blocking the line of sight. The controller is connected with the web drive system and will cause the web drive system to advance the first and second webs toward the packaging station when the signal from the product-sensing detector is of the second type.

As stated, the product-sensing detector can include various types of devices. For example, according to one embodiment having an infeed conveyor belt, the product-sensing detector is a color sensor which can detect the color of the infeed conveyor belt. In another embodiment, the product-sensing detector is a luminescence sensor which can detect the luminance of the infeed belt. This embodiment may also include a luminescence additive that is affixed to the infeed conveyor belt to provide the luminance of the belt.

The present invention may also provide a method for packaging products using continuous first and second webs of flexible packaging material. The method includes advancing the webs toward a packaging station, receiving a product to be packaged onto the first web, and providing a product-sensing detector to determine the presence or absence of a product on the first web. The first web is advanced along a generally horizontal path toward the packaging station and the second web is advanced toward the packaging station such that the webs at the packaging station are in overlying relation and are sealed together with a product enclosed therebetween. The product is received on the first web at a product placement location upstream of the packaging station. The product-sensing detector is adjacent to the first web at or downstream of the product placement location and upstream of the packaging station such that the product-sensing detector has a direct line of sight to the first web when no product is present on the first web and the line of sight is blocked by the product when a product is present on the first web. The product-sensing detector can detect a characteristic of the first web distinct from the products being packaged and provide a signal of a first type when said characteristic is detected and of a second type when said characteristic is not detected, which indicates a product is blocking the line of sight. The first web is advanced toward the packaging station only when the signal from the product-sensing detector is of the second type.

In yet another embodiment of the present invention, the product is received onto an infeed conveyor belt at a product placement location upstream of the packaging station for conveying the product to the packaging station. The product-sensing detector is adjacent to the infeed conveyor belt at or downstream of the product placement location and upstream of the packaging station such that the product-sensing detector has a direct line of sight to the infeed conveyor belt when no product is present on the infeed conveyor belt and the line of sight is blocked by a product when the product is present on the infeed conveyor belt. The product-sensing detector can detect a characteristic of the infeed conveyor belt distinct from the products being packaged and provide a signal of a first type when said characteristic is detected and of a second type when the characteristic is not detected, which indicates a product is blocking the line of sight. The first and second webs are advanced toward the packaging station only when the signal from the product-sensing detector is of the second type.

The present invention has several advantages. The product detector conserves packaging material and energy by ensuring that the packaging apparatus runs only when a product is present for packaging. In circumstances where the products are delivered to the packaging apparatus in small numbers or sporadically, the apparatus does not engage the drive system or advance the webs of packaging material unless the cycle switch is activated and the product detector detects a product. The product detector avoids empty cycles, i.e. running an operating cycle without a product, and the wasted resources associated with empty cycles, by determining whether a product is present before starting the apparatus even after the cycle switch is activated. Also, in circumstances where the products are delivered in a higher volume or close to a continuous stream, the present invention allows for the continuous operation of the packaging apparatus without requiring an operator's supervision and protects against breaks in the delivering of products by shutting down the apparatus until the products continue again.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figures 1, 2:
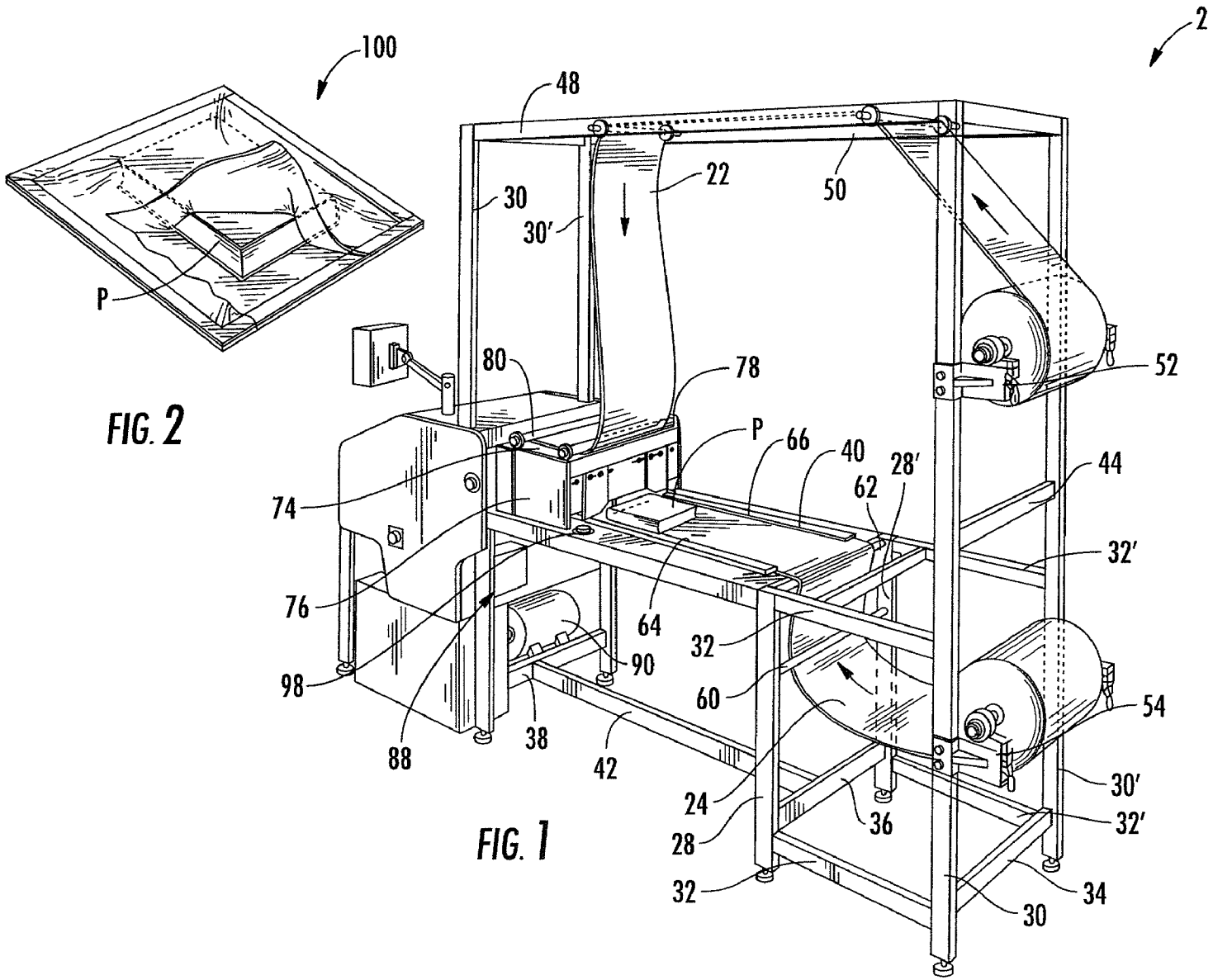
FIG. 1 is a perspective view of a packaging apparatus in accordance with one embodiment of the invention.
FIG. 2 is a perspective view of a package formed by the packaging apparatus.

A packaging apparatus 20 in accordance with one embodiment of the invention is shown in FIG. 1. The apparatus 20 is of the dual-web type for advancing a first or upper web 22 and a second or lower web 24 in generally parallel opposing relation with a product P disposed between the webs 22, 24 and sealing the webs 22, 24 together to capture the product P therebetween. The webs 22, 24 can comprise various materials such as, but not limited to, paper pr paperboard, polymeric films, metal foil, polymeric foam, or combinations thereof. The apparatus 20 includes a main frame having a base formed by a plurality of spaced vertical support columns 26, 28, 30, on one side of a longitudinal axis of the apparatus, and a corresponding plurality of spaced vertical support columns 26', 28', 30' on the opposite side of the longitudinal axis. Upper and lower longitudinal members 32 are rigidly connected between support columns 26 and 28 and between support columns 28 and 30, and similar longitudinal members 32' are rigidly connected between columns 26' and 28' and between columns 28' and 30'. A lower transverse member 34 is rigidly connected between the support columns 26 and 26', a lower transverse member 36 is rigidly connected between the support columns 28 and 28', and a lower transverse member 38 is rigidly connected between the support columns 30 and 30'. A generally planar infeed bed 40 is rigidly connected between the longitudinal members 32, 32'. A lower longitudinal member 42 is rigidly connected between the lower transverse members 36 and 38.

The main frame also includes a superstructure that extends up from the base and above the infeed bed 40. The superstructure is formed by upward extensions of the support columns 26, 26', 30, and 30'. An upper transverse member 44 is rigidly connected between the upper ends of the columns 26 and 26'. An upper longitudinal member 48 is rigidly connected between the upper ends of the columns 26 and 30, and an upper longitudinal member 50 is rigidly connected between the upper ends of the columns 26' and 30'.

Upstream columns 26 and 26' support web mounts 52, 54 that respectively support supply rolls of the webs 22, 24 in a rotatable manner. The upper web 22 is drawn from its supply roll and advanced over a guide 56 supported between the longitudinal members 48, 50, then over a guide 58 supported between the longitudinal members 48, 50 and spaced longitudinally downstream from the first guide 56, and then downward for further handling as described in detail below. The lower web 24 is drawn from its supply roll and advanced under a lower guide 60 supported between columns 28, 28', then over an upper guide 62 supported between columns 28, 28', then onto the upper surface of the infeed bed 40. The infeed bed 40 supports a pair of web edge guides 64, 66 that extend parallel to the longitudinal axis of the machine and are spaced apart by a distance about equal to the width of the lower web 24. The edge guides 64, 66 capture the opposite edges of the web 24 between the infeed bed 40 and the guides 64, 66 and thereby hold the lower web 24 flat on the infeed bed 40 and substantially prevent transverse movement of the web 24, while allowing the web 24 to freely move in the longitudinal direction. A product P to be packaged is placed upon the lower web 24 on the infeed bed 40, as further described below.

Figure 3:
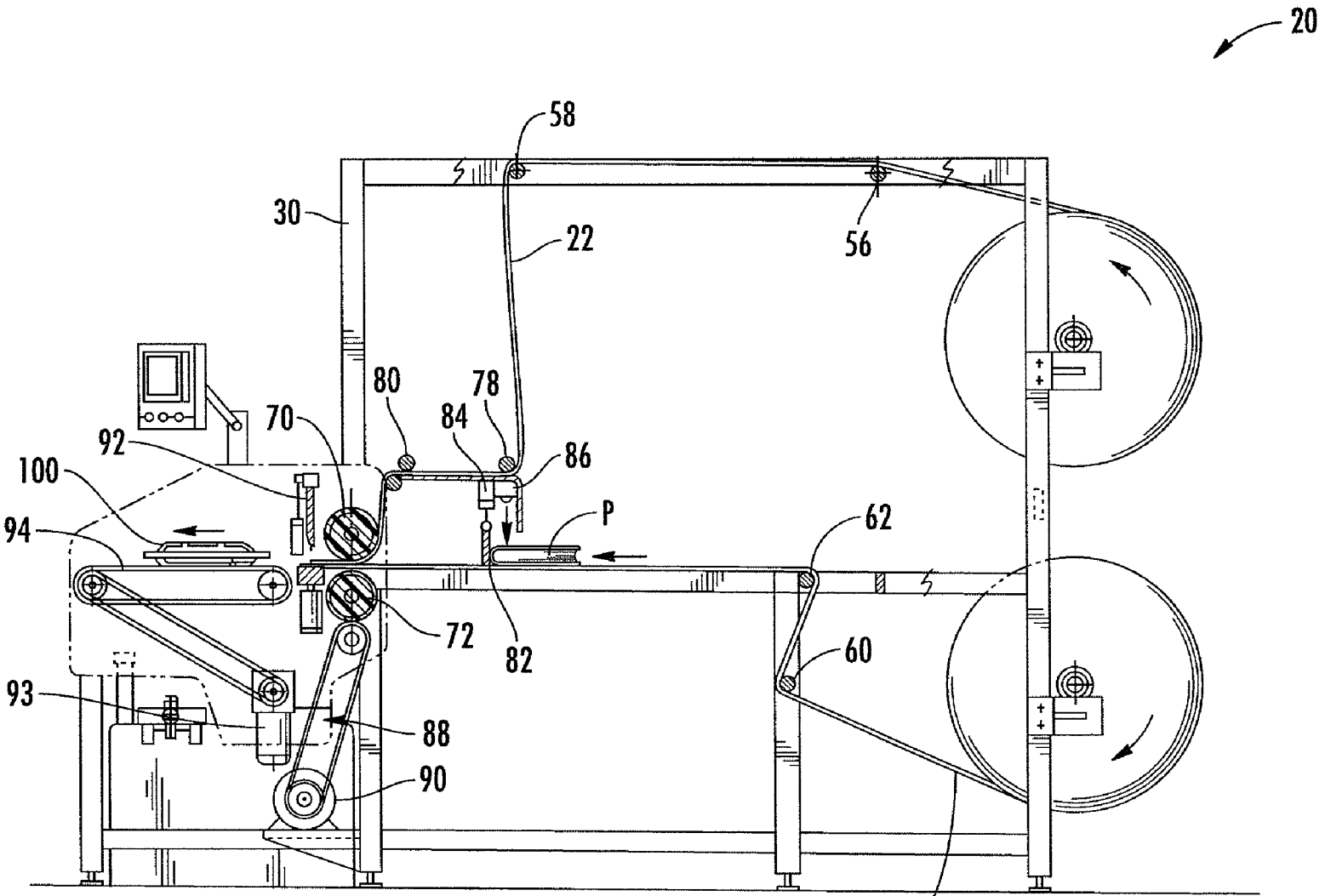
FIG. 3 is a diagrammatic view of a packaging apparatus in accordance with an embodiment of the invention, showing the interconnections of various components of the machine.

With reference to FIGS. 1 and 3, the apparatus 20 includes a pair of rollers 70, 72 that are rotatably mounted in the main frame at a downstream end thereof. The rollers 70, 72 form a sealing, nipping or packaging station at which the webs 22, 24 are sealed together to enclose the product P. Advantageously, one or both of the rollers 70, 72 comprises a resiliently deformable material at least over a medial portion of the roller's length, such that the passage of the product P through the nip deforms the roller(s) 70, 72 and the restoring force of the resiliently deformable material presses the webs 22, 24 toward each other so that the webs 22, 24 conform closely to the product P. The webs 22, 24 advantageously have cold seal or cohesive material on their facing surfaces such that the application of pressure by the rollers 70, 72 causes the webs 22, 24 to adhere to each other but not to the product P. The end portions of each of the rollers 70, 72 advantageously comprise a generally non-deformable material for firmly gripping the opposite edge portions of the webs 22, 24, and the rollers 70, 72 advantageously are rotatably driven for advancing the webs 22, 24 through the apparatus 20, thus comprising a web drive system. Alternatively, a separate web drive system can be employed if desired. Furthermore, other types of packaging stations can be used, such as non-resilient rollers that engage edge portions of the webs 22, 24 to seal them together, heat-sealing devices for heat-sealing the webs together and others.

At a downstream end of the infeed bed 40, an upper web support plate 74 is mounted between a pair of spaced end plates 76, forming a housing that rests atop the base of the main frame. This housing preferably is pivotable relative to the main frame about hinges on a corner of the housing, for access to internal parts of the machine when required for maintenance and the like. The upper web support plate 74 is spaced vertically above the level of the infeed bed 40. The upper web 22 is advanced beneath a pair of longitudinally spaced web guides 78, 80 supported atop the end plates 76, such that the upper web 22 passes along the upper surface of the support plate 74. The support plate 74 provides support for the upper web 22 so that an adhesive label can be affixed to the web 22 either by hand or by a labeling unit.

Figure 4:
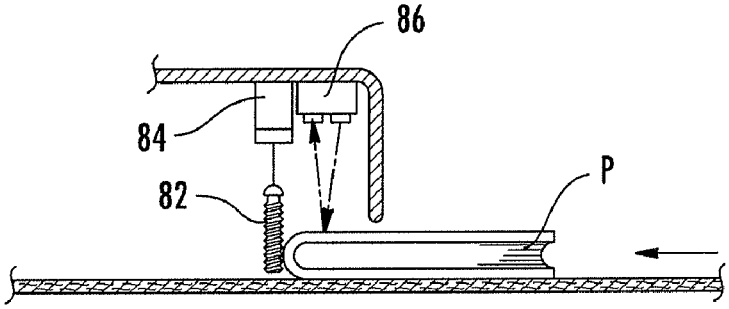
FIG. 4 is a sectioned side view of a portion of a packaging apparatus in accordance with an embodiment of the invention, showing operation of a product detector.
Figure 5:
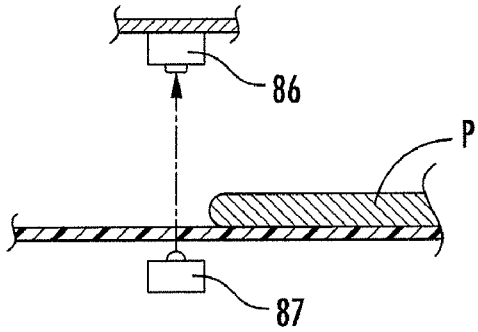
FIG. 5 is a sectioned side view of a portion of a packaging apparatus in accordance with an embodiment of the invention, showing operation of an alternate product detector.

As best seen in FIGS. 4 and 5, the apparatus 20 includes an infeed gate 82 suitably mounted (such as below the upper web support plate 74) in a position upstream of the nip defined by the rollers 70, 72. The infeed gate 82 is connected to an actuator 84, such as a pneumatic cylinder or the like, operable to move the infeed gate 82 between a blocking position wherein the lower edge of the gate 82 abuts or nearly abuts the lower web 24 on the infeed bed 40 and an unblocking position wherein the lower edge of the gate 82 is spaced above the lower web 24 by a distance exceeding a maximum height of the products P to be packaged such that the products P can pass beneath the gate 82. Thus, when a package is to be formed, the infeed gate 82 is lowered to the blocking position and the product P is placed on the lower web 24 with the leading edge of the product P abutting the gate 82. This ensures that the leading edge of the product P is in a consistent, repeatable location with respect to the nip. The location at which the product P is placed onto the lower web 24 or the infeed bed 40, as explained later, is referred to herein as the "product placement location."

Referring to FIGS. 3 through 5, the apparatus 20 also includes a product-sensing detector 86 for detecting the presence of a product P on the lower web 24 at the infeed gate 82. The product detector 86 is located at or downstream of the product placement location. For example, the product detector 86 may be mounted above the lower web just upstream of the infeed gate 82. The detector 86 is positioned such that it has a direct line of sight to the lower web 24 as long as no product P is on the web 24, but so that the line of sight is blocked by any product P present on the web 24. The product detector 86 can comprise various types of devices, including, but not limited to, a sensor trained or calibrated to detect a specific color or illuminance. Examples of available sensors that may be used are the Keyence CZ-40 Digital Fiber-optic Sensor with a CZ-KLP amplifier, or the EMX UVX 300, the former being a color sensor and the later a luminescence sensor.

With a color sensor, the sensor is aimed at the lower web 24 proximate to the upstream side of the infeed gate 82. The sensor is trained to detect the color of the lower web 24. In operation, if the sensor detects the color that the sensor is trained for, i.e., the color of the lower web 24, and then the system controller 88 connected to the sensor determines that no product P is present. Conversely, if the sensor does not detect the trained color, presumably because a product P is blocking the sensor's line of sight to the web 24, then the system controller 88 determines that a product P is present.

Similarly, with a luminescence sensor, the sensor is aimed at the lower web 24 preferably proximate to the upstream side of the infeed gate 82. The sensor is trained to detect the luminance of the lower web 24 including the effect the cohesive has on the luminance. In operation, if the sensor detects the luminance that the sensor is trained for then the system controller 88 determines that no product P is present. Conversely, if the sensor does not detect the trained luminance, presumably because a product P is in the way, then the system controller 88 determines that a product P is present. In order to enhance the detection ability a sensing agent, such as a luminescence or fluorescent additive, may be added to the cohesive that is applied to the webs 22, 24 of material. One example of such an agent is "Leucophor BSB Liquid 130." This additive chemical comes under the general family of anionic stilbene derivatives. The sensor agent provides the web 24 with a more distinct luminance to which the sensor can be trained. One skilled in the art would appreciate that various other additives may be employed with this invention or various other methods can be used to provide the additive on the webs 22, 24, including, but not limited to, mixing the additive with the cohesive or applying or affixing the additive directly to the webs 22, 24 of material.

In other features of the present invention, the sensing agent may be incorporated into the edge area of the webs 22, 24 so that the sensor can detect the edge of each web 22, 24. The sensing agent may also be applied in a unique pattern-like fashion to at least one of the webs 22, 24 allowing the sensor to determine the tension of the web or webs 22, 24, the amount of packaging material left on the supply rolls, the type of web 22, 24, or some other aspects. In some embodiments, the determination of one or more of these aspects is used by the system controller 88 to adjust or maintain one or more of the machines settings, including but not limited to the motors or actuators of the web drive system as discussed further below.

In yet another embodiment, as illustrated in FIG. 5, the product-sensing detector 86 may be a light-sensitive sensor. More specifically, a light source 87 positioned on an opposite side of the lower web 24 from the detector 86 may be used to radiate light through the lower web 24. The light-sensitive detector can monitor the light that passes through the lower web 24. In operation, a product P on the lower web 24 would interfere with the light passing through the lower web 24. The light-sensitive detector can detect the difference in received light caused by the product P blocking the light path. This difference in received light can be used to infer that a product P is either present or absent on the lower web 24.

As noted, the apparatus 20 may also include a system controller 88. The controller 88 can be programmed to control the various motors and actuators of the apparatus 20 that effect movement of the moving parts. In particular, the controller 88 is connected to a motor 90 that drives the nip rollers 70, 72, to a cutoff device 92, to a motor 93 that drives an out-feed conveyor 94, and to an actuator 84 for the infeed gate 82. The controller 88 is also connected to the product detector 86 and receives a signal therefrom.

A manual mode of operation of the apparatus 20 is now explained with primary reference to FIGS. 1 and 3. Rolls of upper and lower webs 22, 24 are mounted in the web mounts 52, 54, respectively. The upper web 22 is threaded through the machine by advancing the web 22 over the guides 56, 58 and then downward and under the guides 78, 80, and then through the nip between rollers 70, 72. The lower web 24 is threaded by advancing the web 24 under guide 60, over guide 62, through the web edge guides 64, 66 and through the nip. To begin a packaging sequence, a product P is placed on the lower web 24 against the infeed gate 82, which is normally down in its blocking position unless the controller 88 commands its actuator 96 to raise the gate 82. Next, a cycle switch is activated. For example, a cycle start button 98 is pressed, which causes a series of operations as follows: based on the signal from the product detector 86, the system controller 88 determines whether a product P is present, and if no product P is present then no further operations occur until the next time the cycle start button 98 is pressed. If a product P is present, then the controller 88 causes the infeed gate 82 to be lifted up to allow the passage of the product P, and causes the web drive system motor 162 to drive the rollers 70, 72 to advance the webs 22, 24 and the product P through the nip to produce a package 100 (as shown in FIG. 2), which is cut off by the cutoff device 92 and conveyed by the out-feed conveyor 94 to the machine discharge. The process generally as described above is repeated for each subsequent package.

Figure 6:
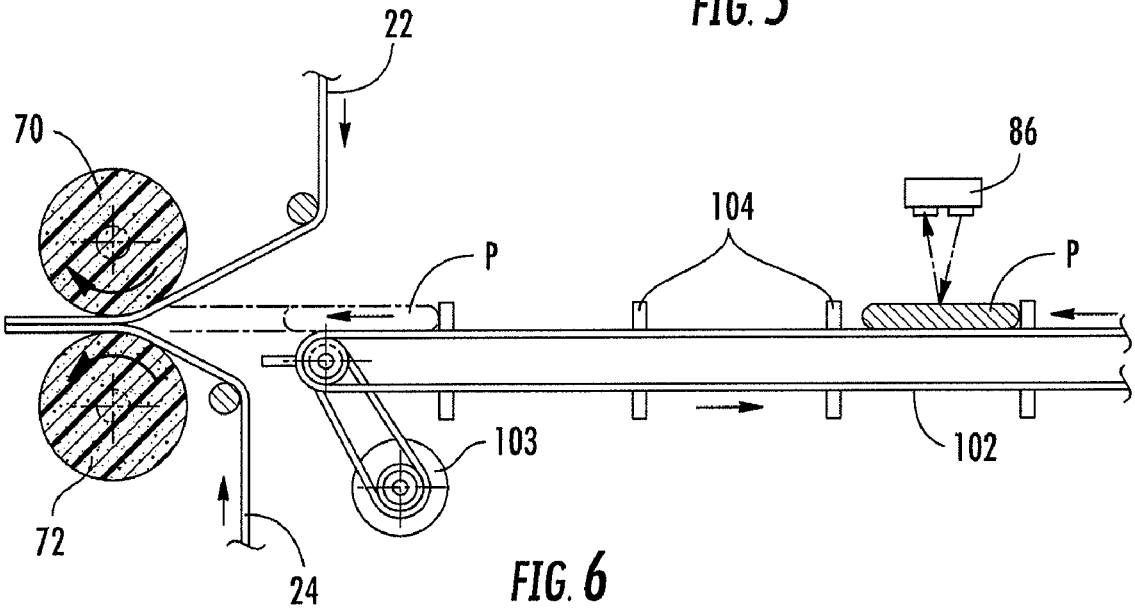
FIG. 6 is a diagrammatic illustration of an alternate embodiment of the packaging apparatus where the infeed bed has a separate conveying system for advancing the product to the nip.

FIG. 6 illustrates another embodiment of a packaging apparatus in accordance with the present invention, wherein the packaging apparatus 20 is suitable for packaging a continuous stream of products P in an automated fashion. The structure of the packaging apparatus 20 according to this embodiment is similar to the ones described above, with some exceptions. The lower web 24 is still drawn from its supply roll and is guided by a series of guides. However, the lower web 24 is not supported by the upper surface of the infeed bed 40. Instead, the lower web 24 travels under and around the infeed bed 40. The infeed bed 40 includes a separate conveying system. For example and as illustrated, the infeed bed 40 may include an endless belt or conveyor 102 driven by a suitable drive device 103. A plurality of pushers 104 are attached to the conveyor 102 at regularly spaced intervals. The pushers 58 project up from the conveyor 102 so the pushers 104 can facilitate the advancement of the products P toward the nip and the products P are fed one at a time into the nip. The movement of the infeed bed conveyor 102 can be continuous or intermittent and can be synchronized with the operation of the other elements of the apparatus 20 as will be understood by those skilled in the art. Products P are delivered and placed one at a time onto the infeed bed conveyor 102 at a product placement location by one or more additional conveying systems, not visible in the drawings. The product-sensing detector 86 in this embodiment is preferably mounted above and aimed at a portion of the infeed conveyor 102 proximate to an upstream end of the conveyor 102. The product detector 86 is trained or calibrated to detect the color or luminance of the belt 102. If the product detector 86 detects a color or luminance other than that of the infeed bed conveyor belt 102 then the system controller 88 infers that a product P is on the infeed bed conveyor belt 102. If the product detector 86 fails to detect any product P after a specified period of time, the controller 88 causes the motor 90 to shut down and stop the advancement of the webs 22, 24. Once the product detector 86 detects a product P again, the controller 88 causes the motor to start up and thus begin to advance the webs 22, 24 again.

The present invention has several advantages. The product detector 86 conserves packaging material and energy by ensuring the running of the packaging apparatus 20 only when a product P is present for packaging. In circumstances where the products P are delivered to the packaging apparatus 20 in small numbers or sporadically, the apparatus 20 won't engage the drive system or advance the webs 22, 24 of packaging material unless the cycle switch is activated and the product detector 86 detects a product P. The product detector 86 avoids empty cycles, i.e. running an operating cycle without a product P, and the wasted resources associated with empty cycles, by determining whether a product P is present before starting the apparatus 20 even after the cycle switch is activated. Also, in circumstances where the products P are delivered in a higher volume or in a continuous stream, the present invention allows for the continuous operation of the packaging apparatus 20 without requiring an operator's supervision and protects against breaks in the delivering of products P by shutting down the apparatus 20 until delivery of the products P continues again.

Many modifications and other embodiments of the invention set forth herein will come to mind to one skilled in the art to which this invention pertain having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for packaging products using continuous first and second webs of flexible packaging material, the apparatus comprising:

a packaging station comprising a pair of rollers forming a nip through which the first and second webs with a product disposed therebetween are advanced in a longitudinal direction such that the webs are adhered to each other and envelop the product;

a web drive system operable to advance the first and second webs to the packaging station, the first web being advanced along a generally horizontal path from a product placement location at which the product to be packaged is placed onto the first web, toward the packaging station;

a product-sensing detector adjacent the first web at or downstream of the product placement location and upstream of the packaging station such that the product-sensing detector has a direct line of sight to the first web when no product is present on the first web, the line of sight being blocked by the product when present on the first web, the product-sensing detector being operable to detect a characteristic of the first web distinct from the products being packaged and to provide a signal of a first type when said characteristic is detected and of a second type when said characteristic is not detected, indicating blockage of the line of sight; and a controller connected with the web drive system and the product-sensing detector, the controller being operable to cause the web drive system to advance the first and second webs toward the packaging station only when the signal from the product-sensing detector is of the second type.

2. The packaging apparatus of claim 1 wherein the product-sensing detector is a color sensor operable to detect a color of the first web.

3. The packaging apparatus of claim 1 wherein the product-sensing detector is a luminescence sensor operable to detect a luminance of the first web.

4. The packaging apparatus of claim 3 wherein a luminescence additive is affixed to the first web to provide the luminance of the first web.

5. An apparatus for packaging products using continuous first and second webs of flexible packaging material, the apparatus comprising:

a packaging station comprising a pair of rollers forming a nip through which the first and second webs with a product disposed therebetween are advanced in a longitudinal direction such that the webs are adhered to each other and envelop the product;

an infeed conveyor belt for conveying the products to the packaging station from a product placement location at which each product to be packaged is placed;

a web drive system operable to advance the first and second webs to the packaging station;

a product-sensing detector adjacent the infeed conveyor belt at or downstream of the product placement location and upstream of the packaging station such that the product-sensing detector has a direct line of sight to the infeed conveyor belt when no product is present on the infeed conveyor belt, the line of sight being blocked by the product when present on the infeed conveyor belt, the product-sensing detector being operable to detect a characteristic of the infeed conveyor belt distinct from the products being packaged and to provide a signal of a first type when said characteristic is detected and of a second type when said characteristic is not detected, indicating blockage of the line of sight; and a controller connected with the web drive system and the product-sensing detector, the controller being operable to cause the web drive system to advance the first and second webs toward the packaging station only when the signal from the product-sensing detector is of the second type.

6. The packaging apparatus of claim 5 wherein the product-sensing detector is a color sensor operable to detect a color of the infeed conveyor belt.

7. The packaging apparatus of claim 5 wherein the product-sensing detector is a luminescence sensor operable to detect a luminance of the infeed conveyor belt.

8. The packaging apparatus of claim 7 wherein a luminescence additive is affixed to the infeed conveyor belt to provide the luminance of the infeed conveyor belt.

9. A method for packaging products using continuous first and second webs of flexible packaging material, comprising the steps of:

advancing the first web along a generally horizontal path toward a packaging station, and advancing the second web toward the packaging station such that the webs at the packaging station are in overlying relation and are sealed together with a product enclosed therebetween;

receiving the product to be packaged onto the first web at a product placement location upstream of the packaging station; and providing a product-sensing detector adjacent the first web at or downstream of the product placement location and upstream of the packaging station such that the product-sensing detector has a direct line of sight to the first web when no product is present on the first web, the line of sight being blocked by the product when present on the first web, the product-sensing detector being operable to detect a characteristic of the first web distinct from the products being packaged and to provide a signal of a first type when said characteristic is detected and of a second type when said characteristic is not detected, indicating blockage of the line of sight;

wherein the first web is advanced toward the packaging station only when the signal from the product-sensing detector is of the second type.

10. The method of claim 9, wherein the product-sensing detector is a color sensor operable to detect a color of the first web.

11. The method of claim 9, wherein the product-sensing detector is a luminescence sensor operable to detect a luminance of the first web.

12. The method of claim 11 further comprising affixing a luminescence additive to the first web to provide a luminance of the first web.

13. The method of claim 12 wherein the luminescence additive is configured in a unique pattern and the product-sensing detector being operable to detect the tension of the first web based on the unique pattern.

14. A method for packaging products using continuous first and second webs of flexible packaging material, comprising the steps of:

advancing the first web along a generally horizontal path toward a packaging station, and advancing the second web toward the packaging station such that the webs at the packaging station are in overlying relation and are sealed together with a product enclosed therebetween;

receiving the product to be packaged onto an infeed conveyor belt at a product placement location upstream of the packaging station for conveying the product to the packaging station; and providing a product-sensing detector adjacent the infeed conveyor belt at or downstream of the product placement location and upstream of the packaging station such that the product-sensing detector has a direct line of sight to the infeed conveyor belt when no product is present on the infeed conveyor belt, the line of sight being blocked by the product when present on the infeed conveyor belt, the product-sensing detector being operable to detect a characteristic of the infeed conveyor belt distinct from the products being packaged and to provide a signal of a first type when said characteristic is detected and of a second type when said characteristic is not detected, indicating blockage of the line of sight;

wherein the first and second webs are advanced toward the packaging station only when the signal from the product-sensing detector is of the second type.

15. The method of claim 14, wherein the product-sensing detector is a color sensor operable to detect a color of the infeed conveyor belt.

16. The method of claim 14, wherein the product-sensing detector is a luminescence sensor operable to detect a luminance of the infeed conveyor belt.

17. The method of claim 16 further comprising affixing a luminescence additive to the infeed conveyor belt to provide a luminance of the infeed conveyor belt.

* * * * *

UNITED STATES PATENT AND TRADEMARK OFFICE

CERTIFICATE OF CORRECTION

PATENT NO. : 7,603,831 B2
APPLICATION NO. : 11/093731
DATED : October 20, 2009
INVENTOR(S) : Sperry et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 947 days.

Signed and Sealed this

Fifth Day of October, 2010

David J. Kappos

David J. Kappos
*Director of the United States Patent and Trademark Office*